US008020217B2

(12) United States Patent
Moore et al.

(10) Patent No.: US 8,020,217 B2
(45) Date of Patent: Sep. 20, 2011

(54) INFANT WRAP AND METHOD FOR USE

(75) Inventors: David M Moore, Garland, TX (US); Peggy Razor Clevinger, Garland, TX (US)

(73) Assignee: Brent A. Waters, Dallas, TX (US)

( * ) Notice: Subject to any disclaimer, the term of this patent is extended or adjusted under 35 U.S.C. 154(b) by 0 days.

(21) Appl. No.: 12/287,823

(22) Filed: Oct. 15, 2008

(65) Prior Publication Data

US 2010/0083418 A1 Apr. 8, 2010

Related U.S. Application Data

(60) Provisional application No. 60/981,362, filed on Oct. 19, 2007.

(51) Int. Cl.
*A41B 13/06* (2006.01)

(52) U.S. Cl. ..... 2/69.5; 2/48; 2/104; 2/49.1

(58) Field of Classification Search ..... 2/69.5, 2/48, 49.1, 49.2, 49.3, 104
See application file for complete search history.

(56) References Cited

U.S. PATENT DOCUMENTS

| | | | | |
|---|---|---|---|---|
| 2,879,514 | A * | 3/1959 | Shapiro | 2/48 |
| 6,505,367 | B2 * | 1/2003 | Griffin et al. | 5/655 |
| 6,536,047 | B1 * | 3/2003 | Mullaly | 2/48 |
| 7,540,035 | B1 * | 6/2009 | Bloom | 2/48 |
| 7,634,818 | B1 * | 12/2009 | Trujillo et al. | 2/48 |
| 2010/0017929 | A1 * | 1/2010 | Kenney | 2/49.1 |

* cited by examiner

*Primary Examiner* — Khoa D Huynh
*Assistant Examiner* — Alissa J Tompkins
(74) *Attorney, Agent, or Firm* — Howison & Arnott, L.L.P.

(57) ABSTRACT

An infant wrap and a method for using such a wrap are provided. In one example, the wrap includes a main body folded with an outer surface of part of the main body facing itself to form at least a partial pouch. The wrap further includes a neck portion having first and second ends coupled to an upper edge of the main body to define a neck hole for the user, and a hood attached to a lower edge of the main body. Fasteners may be used to removably couple various portions of the baby wrap.

11 Claims, 4 Drawing Sheets

INFANT WRAP AND METHOD FOR USE

CLAIM OF PRIORITY

This application claims the benefit of U.S. Provisional Application 60/981,362, filed on Oct. 19, 2007, and entitled INFANT WRAP AND METHOD FOR USE.

BACKGROUND

Caring for an infant is a common task performed millions of times each day. Those who provide such care are generally familiar with the various procedures involved, which typically include washing and drying the infant. As such care providers can attest, a wet infant can be difficult to hold and the drying process frequently involves getting parts of the care provider's clothing wet, as well as whatever else may be in the area. Accordingly, improvements are needed to aid in the infant drying process.

BRIEF DESCRIPTION OF THE DRAWINGS

Aspects of the present disclosure are best understood from the following detailed description when read with the accompanying figures. It is emphasized that various features are not drawn to scale. In fact, the dimensions of the various features may be arbitrarily increased or reduced for clarity of discussion.

DETAILED DESCRIPTION

Figure 1A:
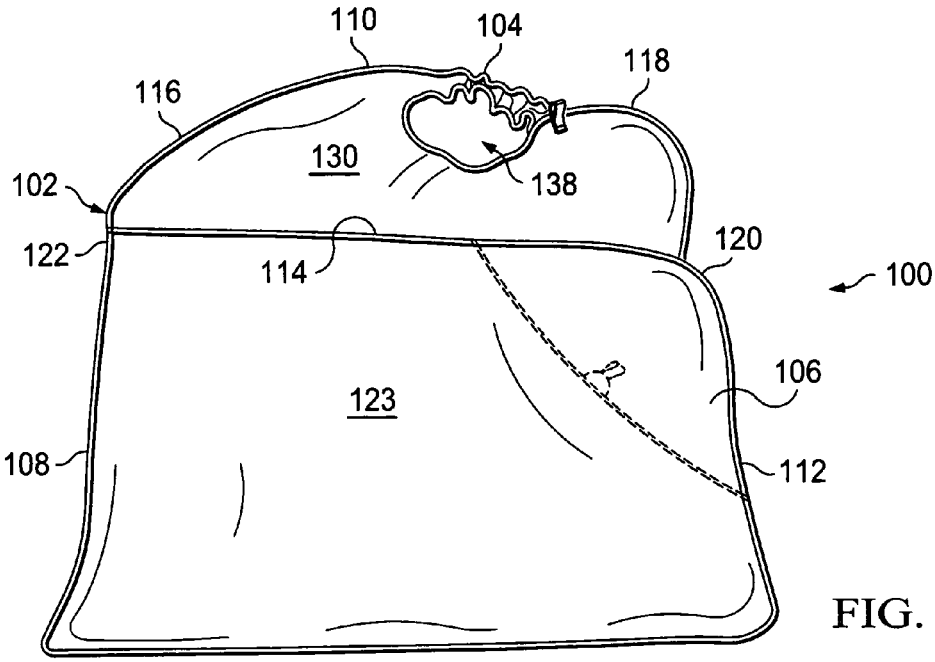
FIGS. 1A and 1B illustrate one embodiment of an infant wrap.

It is to be understood that the following disclosure provides many different embodiments, or examples, for implementing different features of the disclosure. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 1B:
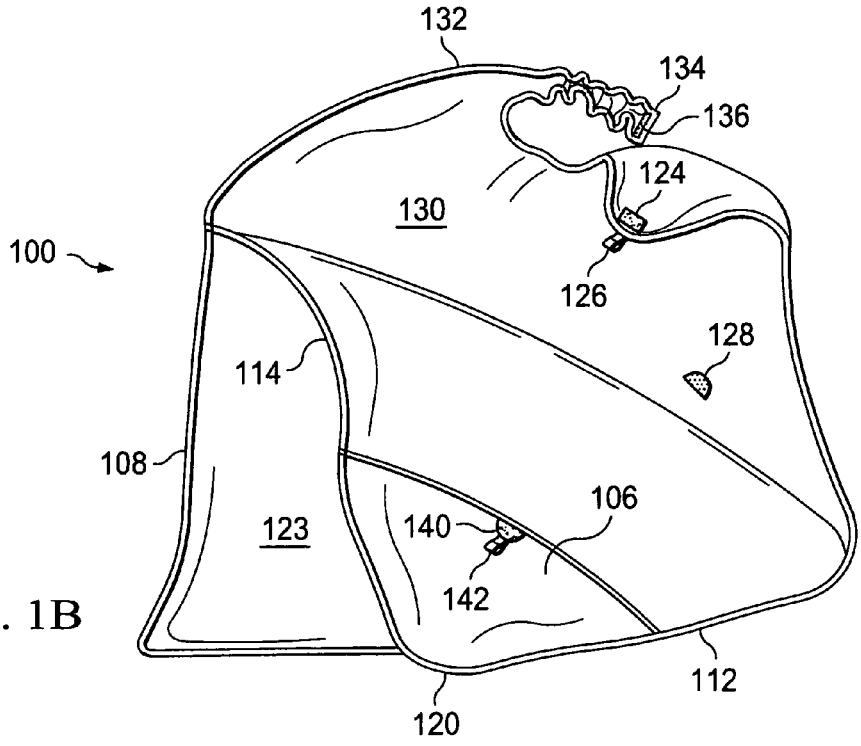

Referring to FIGS. 1A and 1B, in one embodiment, an infant wrap 100 is illustrated. The infant wrap 100 includes a main body 102, a neck band 104, and a hood 106. All or portions of the infant wrap 100 may be made from a relatively soft and absorbent material, such as terry cloth.

In the present example, the main body 102 of the infant wrap 100 is formed by a substantially rectangular piece of cloth having a first edge 108, a second edge 110, a third edge 112, and a fourth edge 114. A first corner 116 joins edges 108 and 110, a second corner 118 joins edges 110 and 112, a third corner 120 joins edges 112 and 114, and a fourth corner 122 joins edges 114 and 108. Some or all of the corners 116, 118, 120, and 122 may be rounded or otherwise shaped. It is understood that the main body 102 may be formed in many shapes (e.g., oval, circular, square, non-symmetrical) and sizes, and need not be a single piece of material.

The interior surface 123 of the main body 102 includes a first fastener 124 positioned at or near the edge 110 and towards the corner 118. The fastener 124 may be any fastener capable of repeatedly fastening and unfastening, such as a snap, button, tie, and/or a hook-and-loop fastening system (e.g., hook-and-loop fasteners sold under the trademark VELCRO, of Velcro Industries B.V.). In the current embodiment, the fastener 124 is a patch that is part of a hook-and-loop fastening system. A tab 126 may be attached to the main body 102 near the edge 110 and fastener 124. The tab 126 may be, for example, a single layer of material or may be formed from a loop of material.

A second fastener 128 may be affixed to an exterior surface (from the perspective of a user) 130 of the main body 102. The fastener 128 may be any fastener capable of repeatedly fastening and unfastening, such as a snap, button, tie, and/or a hook-and-loop fastening system. In the current embodiment, the fastener 128 is a patch that is part of a hook-and-loop fastening system. The fastener 128 may be positioned relative to the upper edge 110 so that the fastener is at approximately the user's left hip, although the position may vary from about the user's lower thigh to about the user's chest. It is understood that the actual position of the fastener 128 may depend not only on the fastener's position relative to the upper edge 110, but also on the height of the user.

The neck band 104 includes ends 132 and 134. In the present example, the end 132 is attached to an upper portion of the main body (e.g., edge 110 and/or 108 and corner 116). The neck band 104 may be a separate piece of fabric with the end 132 removeably or permanently coupled to the main body 102. Alternatively, the neck band 104 may be formed from the same piece of fabric as the main body 102 with the end 132 representing the area where the neck band extends from the main body.

The end 134 includes a third fastener 136 configured to removably couple to the fastener 124. The fastener 136 may be any fastener capable of repeatedly fastening and unfastening, such as a snap, button, tie, and/or a hook-and-loop fastening system. In the current embodiment, the fastener 136 is a patch that is part of a hook-and-loop fastening system. The neck band 104 may include an elastic portion (not shown) that may be exposed or may be covered by cloth of the neck band.

In the present example, the neck band 104 provides an offset neck hole 138 that shifts the main body 102 somewhat to the left (from a user's perspective) on the user's torso. In other embodiments, the neck band 104 may shift the main body 102 in different ways or may center the main body on the user's torso. Accordingly, variations in the shape and/or positioning of the neck band 104 may be used to adjust the main body 102 relative to the user.

The hood 106 may be formed by a piece of cloth that is permanently or removeably attached to the main body 102 on the exterior surface 130. In the present example, the hood 106 is attached to the edges 112 and 114 at the corner 120. Accordingly, when the infant wrap 100 is laid flat, the hood 106 may not be visible when viewed from the back (e.g., the side facing the interior surface). In other embodiments, the hood 106 may overlap the edges 112 and 114 and may be at least partially visible from the back side. In still other embodiments, the corner 120 may be used to form all or a portion of the hood 106. For example, the corner 120 may be folded towards a median line of the main body 102. Alternatively, the main body 102 may include additional material (i.e., other than the rectangle) that is used to form the hood 106.

The hood 106 includes a fourth fastener 140. The fastener 140 may be any fastener capable of repeatedly fastening and unfastening, such as a snap, button, tie, and/or a hook-and-loop fastening system. In the current embodiment, the fastener 140 is a patch that is part of a hook-and-loop fastening system configured to removably couple to the fastener 128. A tab 142 may be attached to the hood 106 near the fastener 140. The tab 142 may be, for example, a single layer of material or may be formed from a loop of material.

Referring to FIGS. 2-7, in one embodiment, an infant wrap (e.g., the infant wrap 100 of FIGS. 1A and 1B) is illustrated in use. It is understood that the infant wrap 100 may not fit different users exactly as illustrated due to differences in the users' heights, for example. Accordingly, the location of various features of the infant wrap 100 (e.g., the location of the tabs 126 and 142) may vary.

Figure 2:
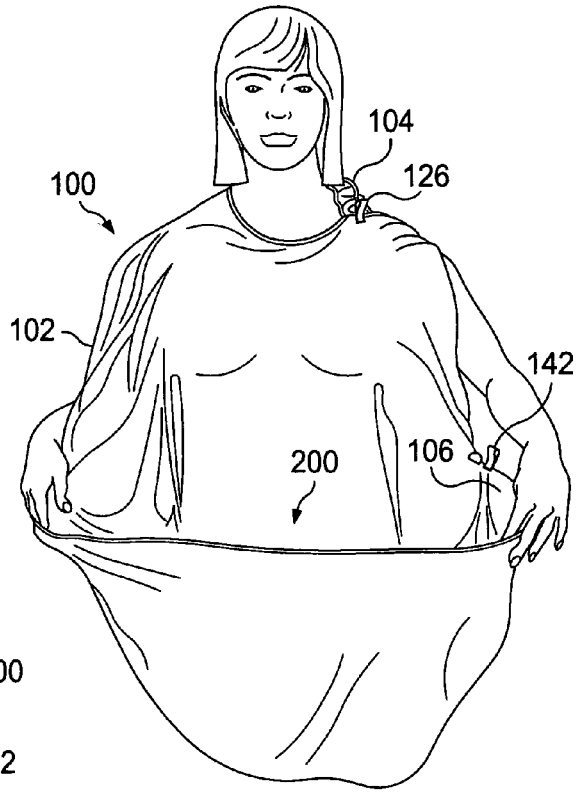
FIG. 2 illustrates one embodiment of the infant wrap of FIGS. 1A and 1B positioned on a user.

FIG. 2 illustrates one possible position of the infant wrap 100 on a user of the infant wrap. In the present example, the bottom portion of the infant wrap 100 is folded upward so that the exterior surface of the bottom portion faces the exterior surface of the bottom portion and/or the middle portion. It is understood that the terms "bottom portion" and "middle portion" are relative and do not denote a specific section of the infant wrap 100.

The bottom portion of the right edge 108 may be folded on itself and attached so that a partial pouch 200 is formed at the bottom of the infant wrap 100. The bottom portion of the right edge 108 may be permanently attached (e.g., sewn) or the attachment may be removable due to the use of one or more fasteners such as the fastener 124 previously described. When the hood 106 is attached to the main body 102 as shown in FIG. 2A, the partial pouch 200 may have a side that is open (as opposed to the sewn side opposite the hood 106 in the present example).

To achieve the positioning of FIG. 2, the end 134 of the neck band 104 is coupled to the main body 102 by joining the fastener 136 to the fastener 124. This may occur prior to the infant wrap 100 being placed on the user (assuming the neck hole 138 is large enough to receive the user's head when the neck band is fastened to the main body) or after the infant wrap is positioned on the user. Regardless of when the attachment of the neck band 104 to the main body 102 occurs, the neck band is placed around the user's neck.

The hood 106 is also coupled to the main body 102 by joining the fastener 140 to the fastener 128. As with the neck band 104, this process may be performed before the infant wrap 100 is positioned on the user or afterwards. As described previously, the hood 106 may attach to the main body 102 at a location that is approximately at the left hip of the user, although this location may change due to differences in the design of the infant wrap 100 and/or due to differences in the height of users.

Figure 3:
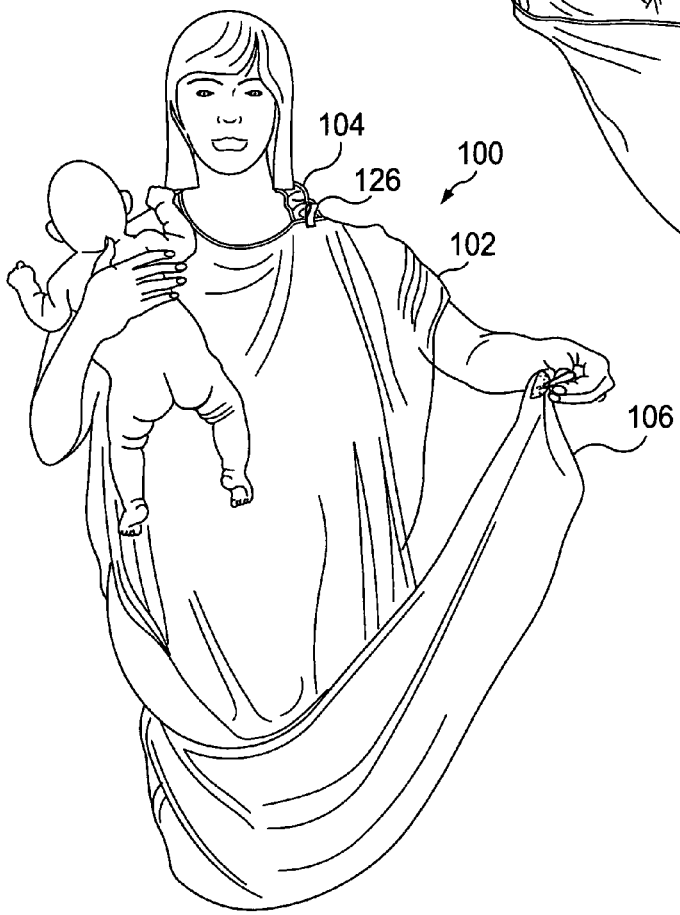
FIG. 3 illustrates the infant wrap of FIG. 2 with an infant placed against the infant wrap.

FIG. 3 illustrates one possible position of an infant positioned against the infant wrap 100. In the present example, the infant's head is placed at approximately the user's right shoulder. FIG. 3 also illustrates the removal of the hood 106 from the main body 102. This may occur by decoupling the fastener 140 from the fastener 128 by, for example, pulling the tab 142 away from the user's hip.

Figure 4:
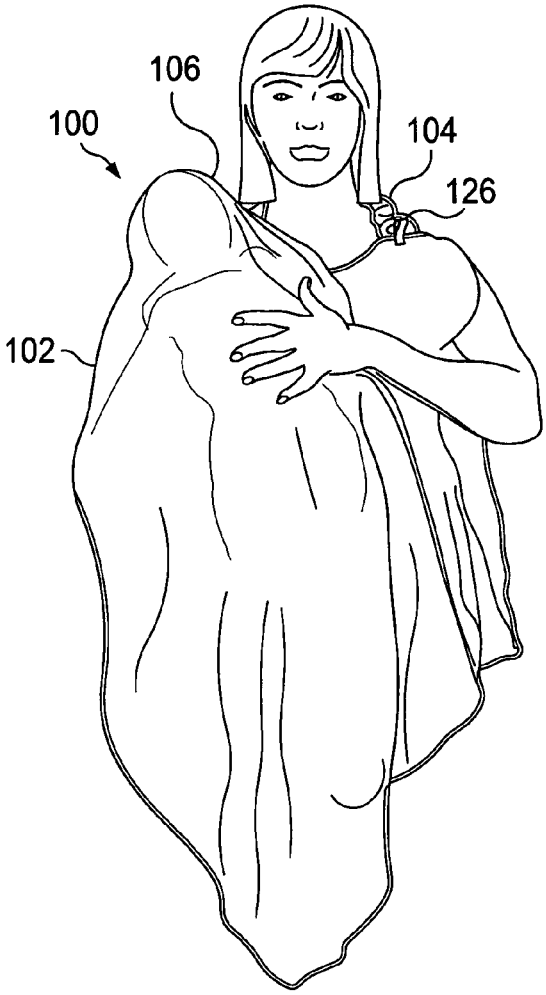
FIG. 4 illustrates the infant wrap of FIG. 2 with a hood attached to the infant wrap placed over the infant's head.

FIG. 4 illustrates the user positioning the hood 106 over the infant's head. It is noted that the fastener 140 and tab 142 may be on the outside of the hood (relative to the infant) to prevent contact between the infant and the fastener and tab.

Figure 5:
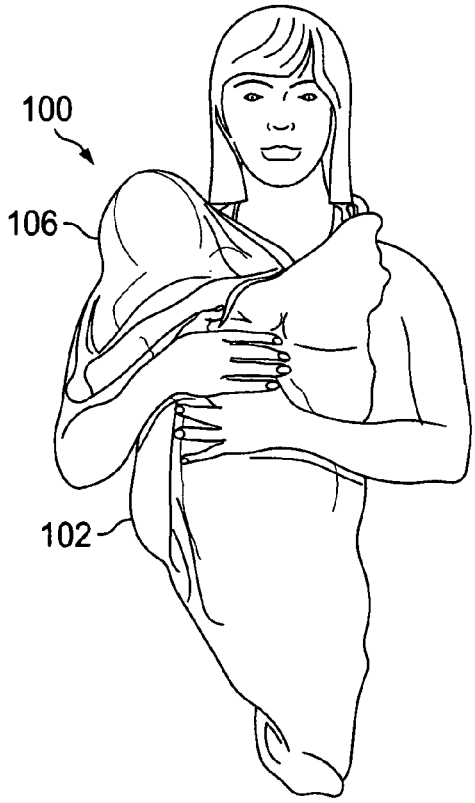
FIG. 5 illustrates the infant wrap of FIG. 2 with the left and right portions of the infant wrap folded around the infant.

FIG. 5 illustrates the user wrapping left and right portions of the middle and lower portions of the infant wrap 100 around the infant.

Figure 6:
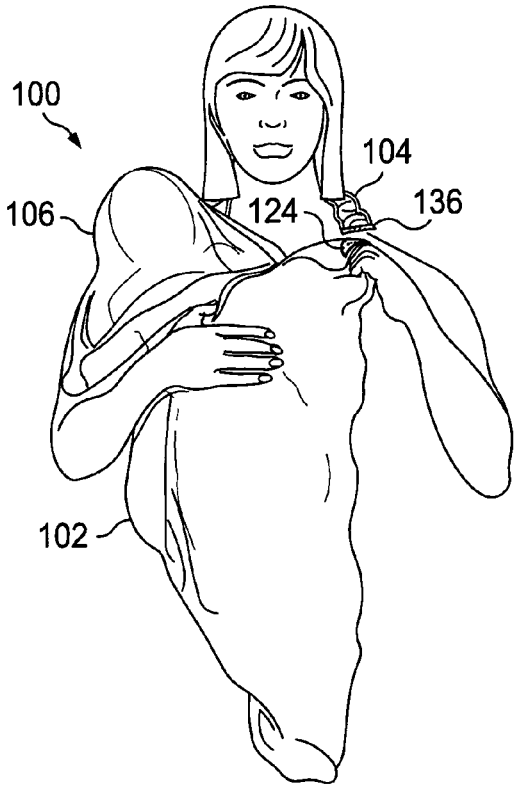
FIG. 6 illustrates the infant wrap of FIG. 2 with one end of a neck band attached to the infant wrap being decoupled from the infant wrap.

FIG. 6 illustrates decoupling the detachable end of the neck band 104 from the upper portion of the main body 102 to facilitate removal of the infant wrap 100 from the user with the infant positioned therein. This may occur by decoupling the fastener 124 from the fastener 136 by, for example, pulling the tab 126 away from the user's body.

Figure 7:
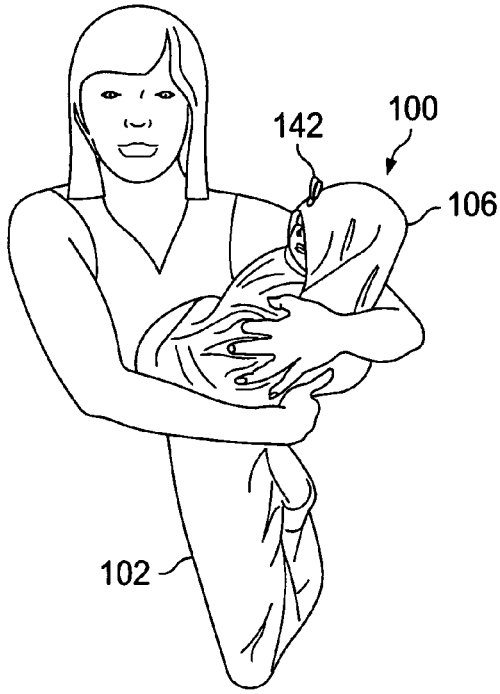
FIG. 7 illustrates the infant wrap of FIG. 2 detached from the user and wrapped around the infant.

FIG. 7 illustrates the user holding the infant, wrapped in the now detached infant wrap 100.

In another embodiment, a method for using the baby wrap 100 of FIG. 1 may include the following. A detachable end of the neck band 104 may be coupled to an upper portion of the infant wrap 100 and the neck band may be placed around a user's neck. The hood 106, which is positioned on a lower portion of the infant wrap 100, may be coupled to a fastening point located on a middle portion of the infant wrap between the user's upper thigh and chest. An infant may be placed against the infant wrap, wherein the infant's head is placed at approximately the user's right shoulder. The hood 106 may be decoupled from the middle portion and positioned over the infant's head. Left and right portions of the middle and lower portions of the infant wrap may be wrapped around the infant. The detachable end of the neck band 104 may be decoupled from the upper portion of the infant wrap to facilitate removal of the infant wrap from the user with the infant positioned therein.

Although only a few exemplary embodiments of this disclosure have been described in details above, those skilled in the art will readily appreciate that many modifications are possible in the exemplary embodiments without materially departing from the novel teachings and advantages of this disclosure. For example, various types of cloth may be used, the pouch 200 may be partially or completely sewn on one or both sides or may be detachable on one or both sides, the hood 106 may be positioned on either side or at a different vertical and/or horizontal location, the neck band 104 may attach on either side, and different shapes (e.g., oval, square, non-symmetrical) and sizes may be used for some or all of the pieces. Also, features illustrated and discussed above with respect to some embodiments can be combined with features illustrated and discussed above with respect to other embodiments. Accordingly, all such modifications are intended to be included within the scope of this disclosure.

What is claimed is:

1. An infant wrap configured to be worn by a user, wrapped around an infant while being worn by the user, and then removed from the user while still wrapped around the infant, the infant wrap comprising:

a main body having an outer surface that is substantially rectangular in shape, wherein the substantially rectangular shape is formed by a first edge, wherein a portion of the first edge is folded on itself and attached to itself to form a partial pouch with a portion of the outer surface facing another portion of the outer surface, an upper second edge coupled to the first edge by a first corner, a third edge coupled to the upper second edge by a second corner, and a fourth edge positioned opposite the upper second edge, wherein the fourth edge is coupled to the third edge by a third corner and coupled to the first edge by a fourth corner, and wherein the main body includes an exterior surface formed from an absorbable cloth and sized to cover at least a majority of the user's torso, an interior surface, a first fastener positioned on the interior surface of the main body near the upper second edge and towards the second corner, and a second fastener positioned on the exterior surface of the main body at a location of the user's left hip when the infant wrap is worn by the user;

a neck band having a first end attached to the upper second edge of the main body and a second end having a third fastener attached thereto, wherein the third fastener is configured to removably couple to the first fastener, and wherein the neck band provides an offset neck hole for the user when the third fastener is coupled to the first fastener; and a hood coupled to the exterior surface of the main body at the third corner and along a portion of the third edge and the fourth edge proximate to the third corner, wherein the hood includes a fourth fastener attached thereto that is configured to removably couple to the second fastener to provide a side of the partial pouch when so coupled.

2. The infant wrap of claim 1 wherein the hood is positioned inside the partial pouch when the fourth fastener is coupled to the second fastener.

3. The infant wrap of claim 1 wherein the hood is removably attached to the main body.

4. The infant wrap of claim 1 wherein the hood and the main body are formed from a single piece of material.

5. The infant wrap of claim 1 further comprising a tab coupled to the hood near the fourth fastener, wherein pulling the tab in a direction away from the user's hip when the infant wrap is worn by the user decouples the fourth fastener from the second fastener.

6. The infant wrap of claim 5 wherein the tab is formed by a loop of material.

7. The infant wrap of claim 1 wherein the first end of the neck band and the main body are formed from a single piece of fabric.

8. The infant wrap of claim 7 wherein the neck band includes an elastic portion.

9. The infant wrap of claim 1 wherein the second and fourth fasteners each comprise a patch that forms part of a hook-and-loop fastening system.

10. The infant wrap of claim 1 wherein the first and third fasteners each comprise a patch that forms part of a hook-and-loop fastening system.

11. An infant wrap comprising:

a main body that is substantially rectangular in shape, wherein the substantially rectangular shape is formed by a first edge, wherein a portion of the first edge is folded on itself and attached to itself to form a partial pouch with a portion of the outer surface facing another portion of the outer surface, an upper second edge coupled to the first edge by a first corner, a third edge coupled to the upper second edge by a second corner, and a fourth edge positioned opposite the upper second edge, wherein the fourth edge is coupled to the third edge by a third corner and coupled to the first edge by a fourth corner, and wherein the main body includes an exterior surface formed from an absorbable cloth and sized to cover at least a majority of the user's torso, an interior surface, a first fastener positioned on the interior surface of the main body near the upper second edge and towards the second corner, and a second fastener positioned on the exterior surface of the main body at a location that is between the user's lower thigh and the user's chest when the infant wrap is worn by the user;

a neck band having a first end attached to the upper second edge of the main body and a second end having a third fastener attached thereto, wherein the third fastener is configured to removably couple to the first fastener, and wherein the neck band provides an offset neck hole for the user when the third fastener is coupled to the first fastener; and a hood coupled to the exterior surface of the main body at the third corner and along a portion of the third edge and the fourth edge proximate to the third corner, wherein the hood includes a fourth fastener attached thereto that is configured to removably couple to the second fastener to provide a side of the partial pouch.

* * * * *